US010138903B2

(12) United States Patent
Uda

(10) Patent No.: US 10,138,903 B2
(45) Date of Patent: Nov. 27, 2018

(54) MULTI-BLADE FAN

(71) Applicant: DAIKIN INDUSTRIES, LTD., Osaka-shi, Osaka (JP)

(72) Inventor: Masafumi Uda, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/107,097

(22) PCT Filed: Dec. 18, 2014

(86) PCT No.: PCT/JP2014/083574
§ 371 (c)(1),
(2) Date: Jun. 21, 2016

(87) PCT Pub. No.: WO2015/098700
PCT Pub. Date: Jul. 2, 2015

(65) Prior Publication Data

US 2017/0051760 A1 Feb. 23, 2017

(30) Foreign Application Priority Data

Dec. 27, 2013 (JP) ..... 2013-272150

(51) Int. Cl.
*F04D 29/66* (2006.01)
*F04D 17/04* (2006.01)
*F04D 29/28* (2006.01)

(52) U.S. Cl.
CPC ..... *F04D 29/666* (2013.01); *F04D 17/04* (2013.01); *F04D 29/283* (2013.01)

(58) Field of Classification Search
CPC ..... F04D 17/04; F04D 29/281; F04D 29/282; F04D 29/283; F04D 29/666; F24F 13/24
See application file for complete search history.

(56) References Cited

U.S. PATENT DOCUMENTS 4,538,963 A * 9/1985 Sugio ..... F04D 29/283 415/119
6,158,954 A * 12/2000 Nabeshima ..... F04D 29/283 415/119

(Continued)

FOREIGN PATENT DOCUMENTS

EP 0 785 362 A1 7/1997
JP 3484854 B2 1/2004
JP 5804044 B2 11/2015

OTHER PUBLICATIONS

International Preliminary Report of corresponding PCT Application No. PCT/JP2014/83574 dated Jul. 7, 2016.

(Continued)

*Primary Examiner* — Ninh H Nguyen
*Assistant Examiner* — Brian O Peters
(74) *Attorney, Agent, or Firm* — Global IP Counselors, LLP

(57) ABSTRACT

A multi-blade fan includes a support body rotatable about a rotary shaft, and a plurality of blades secured to the support body such that an inter-blade pitch angle relative to the rotary shaft assumes a prescribed arrangement. The blades extend along an axial direction of the rotary shaft. The plurality of blades are disposed such that, with respect to amplitude values of periodic functions at individual orders when the prescribed arrangement is expanded in a periodic Fourier series, a maximum amplitude value is less than 200% of a second-largest amplitude value.

7 Claims, 8 Drawing Sheets

(56) References Cited

U.S. PATENT DOCUMENTS

| | | | | |
|---|---|---|---|---|
| 6,345,951 | B1 * | 2/2002 | Choi | F04D 29/283 415/1 |
| 6,761,040 | B2 * | 7/2004 | Ahn | F01D 5/14 416/203 |
| 2003/0192337 | A1 | 10/2003 | Ahn et al. | |

OTHER PUBLICATIONS

International Search Report of corresponding PCT Application No. PCT/JP2014/083574 dated Mar. 3, 2015.
European Search Report of corresponding EP Application No. 14 87 3315.7 dated Feb. 22, 2017.

* cited by examiner

MULTI-BLADE FAN

CROSS-REFERENCE TO RELATED APPLICATIONS

This U.S. National stage application claims priority under 35 U.S.C. § 119(a) to Japanese Patent Application No. 2013-272150, filed in Japan on Dec. 27, 2013, the entire contents of which are hereby incorporated herein by reference.

TECHNICAL FIELD

The present invention relates to a cross-flow fan or other type of multi-blade fan.

BACKGROUND ART

There are conventionally known blowers in which a cross-flow fan or other type of multi-blade fan is used, wherein wind noise is produced by multiple blades. To counteract a wind noise component having a fundamental frequency related to the number of rotations N and the number of blades Z (referred to below as "NZ noise") from within the wind noise, values of the angle of the pitch between the blades of the cross-flow fan are arranged at random (random pitch angle arrangement), whereby the inter-blade pitch angle arrangement is varied to reduce noise. Such variation of the inter-blade pitch angle arrangement produces increases/decreases and/or time distortion in acoustic-pressure fluctuation, which causes the NZ noise, to offset the timing at which the NZ noise is generated, making it possible to minimize increases in unpleasant noise by reducing the prominence of NZ noise having a characteristic frequency.

However, in conventional methods for determining such inter-blade pitch angle arrangements randomly, the amount by which the NZ noise is reduced changes for each determination of the arrangement, resulting in an unpredictable, ad-hoc method of solution.

Furthermore, there are many cases in which the randomly determined arrangement coincidentally matches an inter-blade pitch angle arrangement in which noise is prominent at low frequencies; in order to obtain an optimal arrangement in which noise prominent at low frequencies is suppressed while significantly reducing NZ noise, it is necessary repeatedly to perform a process of trial-and-error. This is not an efficient method for determining the inter-blade pitch angle arrangement for blowers in which the cross-flow fans have different specifications, such as with respect to number of blades.

In the method for determining inter-blade pitch angle arrangement described in, e.g., Japanese Patent No. 3484854, an arrangement is imparted such that a sine waveform of a particular order is obtained when the inter-blade pitch angle arrangement is expanded in a Fourier series. When the inter-blade pitch angle arrangement is determined in this manner, the NZ noise is linked to the reduction of low-frequency broadband noise.

SUMMARY

Technical Problem

However, although NZ noise and low-frequency broadband noise are reduced in the determination method of Japanese Patent No. 3484854, the rotation noise of the cross-flow fan having the order used in the sine wave; i.e., discrete-frequency noise relating to a rotation speed (referred to below as "N noise") alone is increasingly independently prominent. This low-frequency, independently prominent noise is an unpleasant abnormal noise similar to the NZ noise, inhibiting a noise-reduction property intended to improve the multi-blade fan.

The problem of the present invention is to provide a multi-blade fan in which the prominence of wind noise, low-frequency broadband noise, and specific discrete-frequency noise is minimized, and in which a noise-reduction property is enhanced.

Solution to Problem

A multi-blade fan according to a first aspect of the present invention comprises: a support body that rotates about a rotary shaft; and a plurality of blades secured to the support body such that an inter-blade pitch angle relative to the rotary shaft assumes a prescribed arrangement, the blades extending along an axial direction of the rotary shaft; the plurality of blades being disposed such that, with respect to the amplitude values of periodic functions at individual orders when the prescribed arrangement is expanded in a periodic Fourier series, the maximum amplitude value is less than 200% of the second-largest amplitude value.

In the multi-blade fan according to the first aspect, because the maximum amplitude value is less than 200% of the second-largest amplitude value with respect to the amplitude values of periodic functions at individual orders when the prescribed disposition is expanded in a periodic Fourier series, the inhibiting of noise reduction, caused by the prominence of only a order having the maximum amplitude and the production of unpleasant low-frequency noise, is mitigated.

A multi-blade fan according to a second aspect of the present invention is the multi-blade fan according to the first aspect of the present invention, wherein the plurality of blades are disposed such that, with respect to the amplitude values of periodic functions at individual orders of the periodic Fourier series, the second-largest amplitude value and the third-largest amplitude value are within a range of 50-100% of the maximum amplitude value.

In the multi-blade fan according to the second aspect, because the periodic function having the second-largest amplitude value and the periodic function having the third-largest amplitude value have an amplitude value that is within a range of 50-100% of the maximum amplitude value, the magnitudes of the amplitude values of periodic functions having large relative amplitude values are not far removed from each other; therefore, the effects of not only the periodic function having the maximum amplitude value but also the periodic function having the second-largest amplitude value are insignificant.

A multi-blade fan according to a third aspect of the present invention is the multi-blade fan according to the second aspect of the present invention, wherein the plurality of blades are disposed such that the amplitude values of periodic functions at a number of orders equal to or greater than one-third of the total number of orders of the periodic Fourier series are within a range of 50-100% of the maximum amplitude value.

In the multi-blade fan according to the third aspect, because the number of orders having large relative amplitude values, such that the magnitude of the amplitude values of the periodic functions are within a range of 50-100% of the maximum amplitude value, accounts for one-third or more of the total number of orders, the effects of not only the periodic function having the maximum amplitude value but also other periodic functions having large amplitude values are insignificant.

A multi-blade fan according to a fourth aspect of the present invention is the multi-blade fan according to the third aspect of the present invention, wherein the plurality of blades are disposed such that the amplitude values of periodic functions at a number of orders equal to or greater than one-half of the total number of orders of the periodic Fourier series are within a range of 50-100% of the maximum amplitude value.

In the multi-blade fan according to the fourth aspect, because the number of orders having large relative amplitude values, such that the magnitude of the amplitude values of the periodic functions are within a range of 50-100% of the maximum amplitude value, accounts for one-half or more of the total number of orders, the effects of not only the periodic function having the maximum amplitude value but also other periodic functions having large amplitude values are insignificant.

A multi-blade fan according to a fifth aspect of the present invention is the multi-blade fan according to any of the first through fourth aspects of the present invention, wherein the plurality of blades are such that a selection is made from lower orders where the order of a periodic function that has an amplitude value within a range of 50-100% of the maximum amplitude value is two or greater.

In the multi-blade fan according to the fifth aspect, because the amplitude values of low-order-side periodic functions are grouped so as to be within a range of 50-100% of the maximum amplitude value, the effect for dispersing NZ noise is enhanced.

A multi-blade fan according to a sixth aspect of the present invention is the multi-blade fan according to any of the first through fifth aspects of the present invention, wherein the plurality of blades are disposed such that a first-order amplitude value when the prescribed arrangement is expanded in a periodic Fourier series is zero.

In the multi-blade fan according to the sixth aspect, because the amplitude value of a first-order periodic function is zero, the center of gravity does not significantly deviate from the shaft.

Advantageous Effects of Invention

In the multi-blade fan according to the first aspect of the present invention, it is possible not only to reduce wind noise and low-frequency broadband noise, but also to suppress the prominence of specific discrete-frequency noise and to enhance a noise-reduction property.

In the multi-blade fan according to the second aspect of the present invention, the unpleasantness of noise generated along with the rotation of the multi-blade fan is mitigated.

In the multi-blade fan according to the third aspect of the present invention, the effect for mitigating the unpleasantness of noise generated along with the rotation of the multi-blade fan is enhanced.

In the multi-blade fan according to the fourth aspect of the present invention, the effect for mitigating the unpleasantness of noise generated along with the rotation of the multi-blade fan is enhanced.

In the multi-blade fan according to the fifth aspect of the present invention, a multi-blade fan having a high NZ-noise-dispersing effect is obtained.

In the multi-blade fan according to the sixth aspect of the present invention, it is possible to minimize problems due to disruption to rotational balance.

DESCRIPTION OF EMBODIMENTS (1) Cross-Flow Fan Inside Indoor Unit

Figure 1:
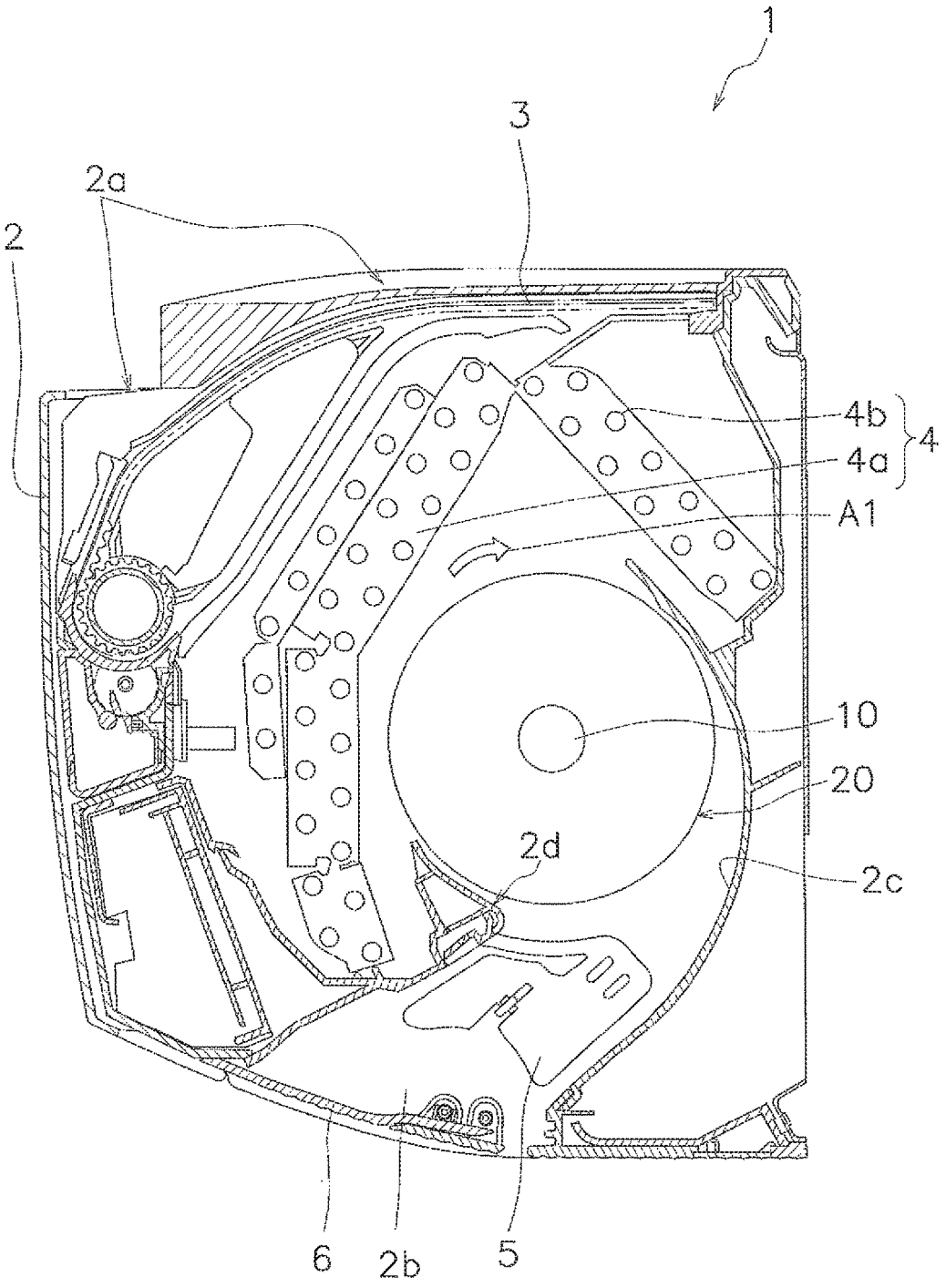
FIG. 1 is a schematic cross-sectional view of an indoor unit in an air-conditioning apparatus.

A cross-flow fan according to a first embodiment of the present invention is described below through the example of a cross-flow fan installed in an indoor unit of an air-conditioning apparatus. FIG. 1 is a schematic view of a cross-section of an indoor unit 1 of an air-conditioning apparatus. The indoor unit 1 comprises a main casing 2, an air filter 3, an indoor heat exchanger 4, a cross-flow fan 10, a vertical flap 5, and a horizontal flap 6.

As shown in FIG. 1, the air filter 3 is disposed downstream from an intake port 2*a* in a ceiling surface of the main casing 2 so as to face the intake port 2*a*. The indoor heat exchanger 4 is disposed further downstream from the air filter 3. The indoor heat exchanger 4 is configured by coupling a front-surface-side heat exchanger 4*a* and a rear-surface-side heat exchanger 4*b* so as to form an inverse V-shape as viewed from a side surface. The front-surface-side heat exchanger 4*a* and the rear-surface-side heat exchanger 4*b* are configured by attaching a plurality of plate fins to a heat-transfer pipe aligned in parallel with a width direction of the indoor unit 1. All of indoor air that passes through the intake port 2*a* and reaches the indoor heat exchanger 4 passes through the air filter 3, and dirt and grit in the indoor air is removed therefrom. The indoor air that has been drawn in through the intake port 2*a* and passed through the air filter 3 is subjected to heat-exchange and air-conditioning when passing between the plate fins of the front-surface-side heat exchanger 4*a* and rear-surface-side heat exchanger 4*b*.

The cross-flow fan 10, which is substantially cylindrical in shape, is provided downstream from the indoor heat exchanger 4 so as to extend longitudinally along a width direction of the main casing 2. The cross-flow fan 10 is disposed in parallel with the indoor heat exchanger 4. The cross-flow fan 10 comprises an impeller 20 disposed in a space surrounded so as to be sandwiched in the inverse V-shape of the indoor heat exchanger 4, and a fan motor (not shown) configured and arranged to drive the impeller 20. The cross-flow fan 10 generates an airflow from the indoor heat exchanger 4 toward a vent 2*b* by the rotation of the impeller 20 in a direction A1 shown by arrows in FIG. 1 (i.e., clockwise). Specifically, the cross-flow fan 10 is a transverse fan, configured such that the airflow passes transversely across the cross-flow fan 10.

A rear-surface side of a vent passage linked to the vent 2*b* downstream from the cross-flow fan 10 is configured from a scroll member 2*c*. A lower end of the scroll member 2*c* is coupled to a lower edge of an opening of the vent 2*b*. In order to guide indoor air, which is vented out from the cross-flow fan 10, smoothly and silently to the vent 2*b*, a guide surface of the scroll member 2*c* has a smooth curved shape having a center of curvature on the cross-flow-fan 10 side as viewed in cross-section. A tongue part 2*d* is formed on the front-surface side of the cross-flow fan 10, and an upper surface of the vent passage that is continuous from the tongue part 2*d* is coupled to an upper edge of the vent 2*b*. A direction in which the airflow is vented out from the vent 2*b* is adjusted using the vertical flap 5 and horizontal flap 6.

(2) Blade Structure of Cross-Flow Fan

Figure 2:
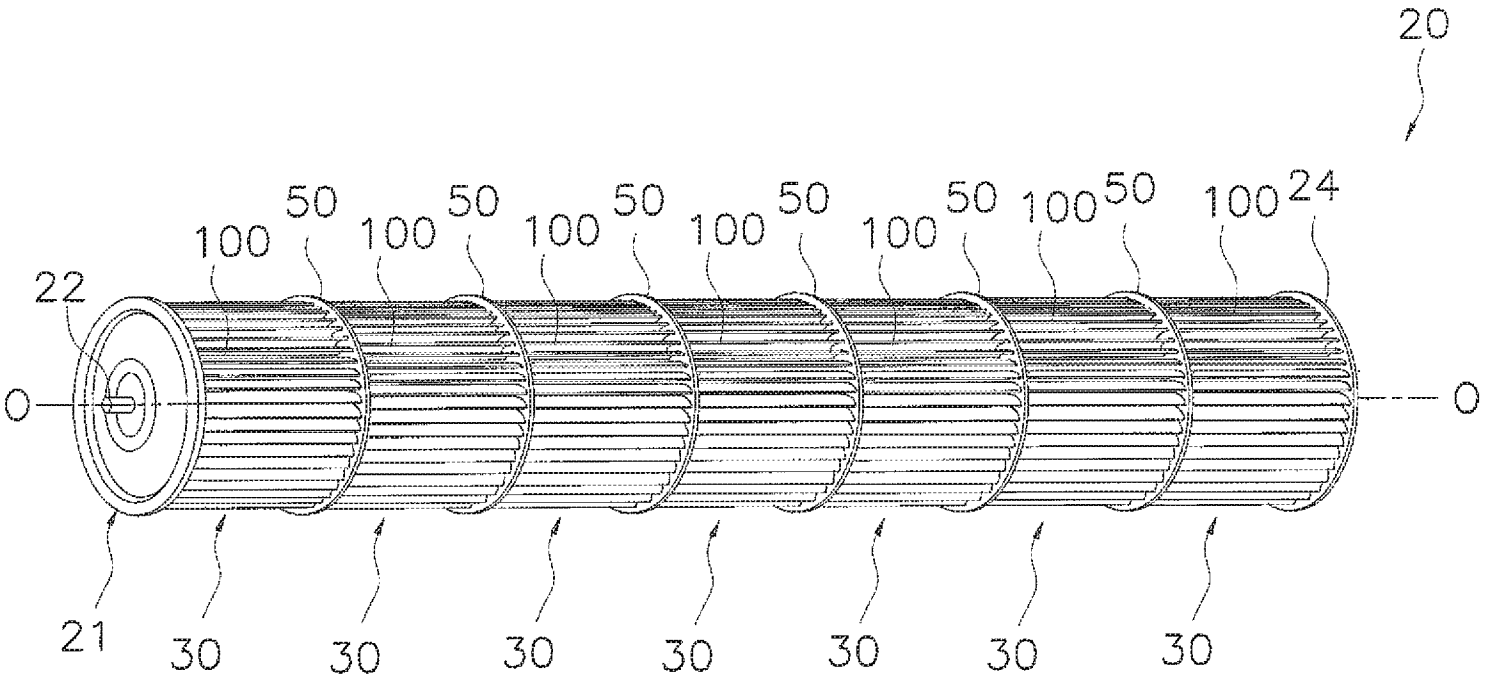
FIG. 2 is a schematic perspective view of an impeller of a cross-flow fan according to a first embodiment.

FIG. 2 shows a schematic structure of the impeller 20 of the cross-flow fan 10. The impeller 20 is configured such that, e.g., end plates 21, 24 and a plurality of fan blocks 30 are joined together. In the present example, seven fan blocks 30 are joined together. An end plate 21 is disposed on one end of the impeller 20, and a metal rotary shaft 22 is provided along a central axis O. Each of the fan blocks 30 comprises a plurality of blades 100 and an annular support plate 50.

Figure 3:
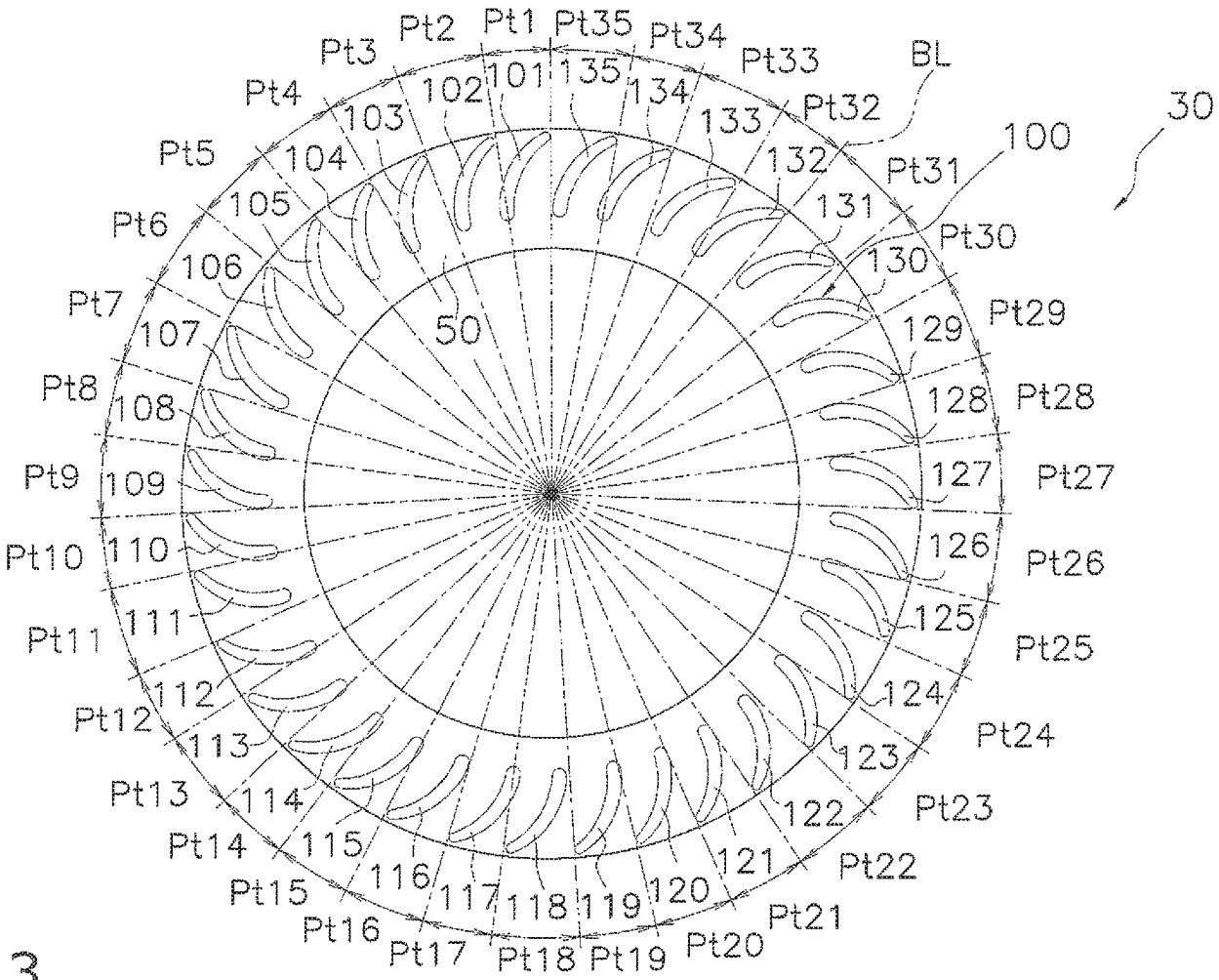
FIG. 3 is a top view for illustrating the disposition of a plurality of blades of the cross-flow fan.

FIG. 3 shows the disposition of a plurality of blades 100 secured to the support plate 50 of one of the fan blocks 30. The plurality of blades 100 shown in FIG. 3 comprise 35 blades, from a first blade 101 to a $35^{th}$ blade 135. In FIG. 3, chain lines extending radially from a center of the support plate 50 indicate reference lines BL configured and arranged to determine inter-blade pitch angles Pt1-Pt35. In a top view, the reference lines BL are tangent lines that pass through the center of the support plate 50 and contact the blade-outer-peripheral sides of each of the first through $35^{th}$ blades 101-135. The angle formed by the reference line BL of the first blade 101 and the reference line BL of the second blade 102 is a first inter-blade pitch angle Pt1, the angle formed by the reference line BL of the second blade 102 and the reference line BL of the third blade 103 is a second inter-blade pitch angle Pt2, etc.; the angle formed by the reference line BL of the $35^{th}$ blade 135 and the reference line BL of the first blade 101 is a $35^{th}$ inter-blade pitch angle Pt35. In descriptions given below, the symbol numbers from the first inter-blade pitch angle Pt1 to the $35^{th}$ inter-blade pitch angle Pt35 are referred to as "pitch numbers." Specifically, the pitch number of the first inter-blade pitch angle Pt1 is 1, the pitch number of the second inter-blade pitch angle Pt2 is 2, etc., and the pitch number of the $35^{th}$ inter-blade pitch angle Pt35 is 35.

In the fan block of the cross-flow fan 10 in FIG. 3, the value $\theta_k$ of the $k^{th}$ inter-blade pitch angle Ptk of pitch number k (where k=1, . . . , 35) is disposed in an inter-blade pitch angle arrangement $\theta_k$ given by formula (1), the inter-blade pitch angle arrangement $\theta_k$ being expanded in a periodic Fourier series. In formula (1), Z indicates the number of blades 100 disposed around the circumference, and A1 indicates the maximum order value. The maximum value of the order of the sine functions is given by the largest integer that does not exceed the value obtained by dividing the number of blades by 2.

< Formula 1 >

$$\theta_k = \theta_0 + \sum_{m=1}^{M} \alpha_m \cdot \sin\left(2\pi \frac{mk}{Z} + \beta_m\right) \tag{1}$$

$$(k = 1, \Lambda, Z), \left( \begin{array}{l} M = \frac{Z}{2} (\text{where } Z \text{ is even}) \\ M = \frac{(Z-1)}{2} (\text{where } Z \text{ is odd}) \end{array} \right)$$

In the formula, Z is a natural number equal to or greater than 6;

k=1, Λ, Z (where k is a natural number);

m=1, Λ, M (where m is a natural number);

$\theta_k$=arrangement of each of the inter-blade pitch angles (degree);

$$\theta_0 = \frac{360}{Z}$$

(angle in the case of equal-interval pitches) (degree);

$\alpha_m$=amplitude value of sine functions of order m; and $\beta_m$=phase shift of sine functions of order m.

The inter-blade pitch angle arrangement $\theta_k$ is determined in accordance with the following stipulations.

In formula (1), with respect to an amplitude value $\alpha_m$ of the sine functions of individual orders m, when the maximum amplitude value is designated as αmax and the second-largest amplitude value is designated as α2nd, the amplitude values are determined so as to satisfy the relationship αmax<2×α2nd. Specifically, the inter-blade pitch angle arrangement $\theta_k$ is an arrangement in which the maximum amplitude value αmax is less than 200% of the second-largest amplitude value α2nd. Such an inter-blade pitch angle arrangement $\theta_k$ is referred to below as a "low-N-noise arrangement."

Figure 4:
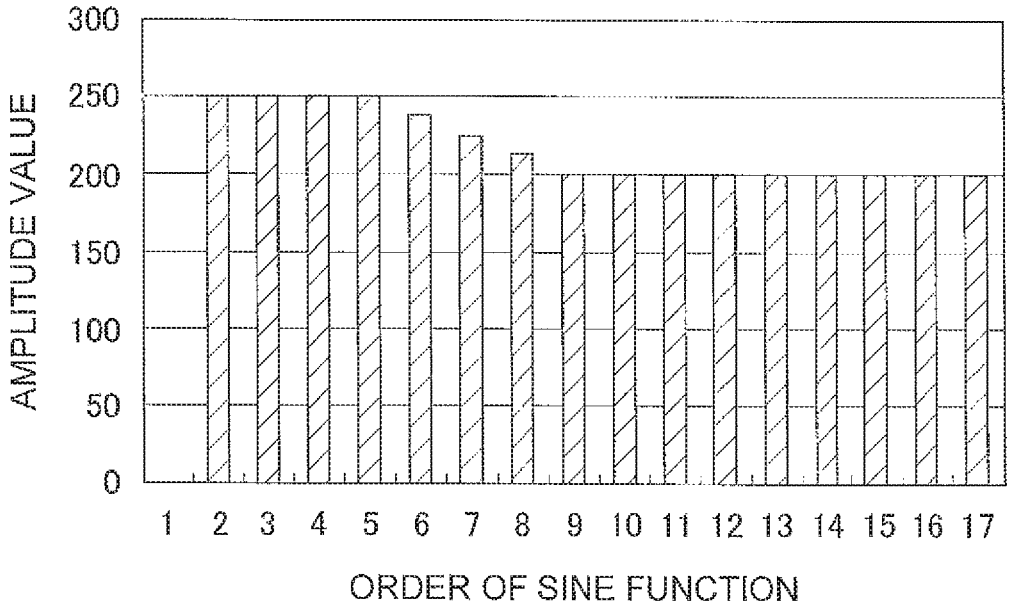
FIG. 4 is a graph showing one example of a relationship between sine function order and amplitude value according to an embodiment.

FIG. 4 is a graph showing one example of the relationship between sine function order and amplitude value, for forming a low-N-noise arrangement. Because there are 35 blades in the plurality of blades 100, it is possible to represent the inter-blade pitch angle arrangement $\theta_k$ by using the sum from the first-order sine function through the $17^{th}$-order sine function when the inter-blade pitch angle arrangement $\theta_k$ is expanded in a periodic Fourier series using sine functions.

As shown in FIG. 4, the amplitude value $\alpha_1$ of the first-order sine function is 0. The amplitude values $\alpha_2$, $\alpha_3$, $\alpha_4$, as from the second-order sine function through the fifth-order sine function are all 250. The amplitude values $\alpha_9$, $\alpha_{10}$, $\alpha_{11}$, $\alpha_{12}$, $\alpha_{13}$, $\alpha_{14}$, $\alpha_{15}$, $\alpha_{16}$, $\alpha_{17}$ from the ninth-order sine function through the $17^{th}$-order sine function are all 200. The amplitude values $\alpha_6$, $\alpha_7$, $\alpha_8$ from the sixth-order sine function through the eighth-order sine function are between 250 and 200, becoming smaller in sequence. Comparing the amplitude values $\alpha_1$-$\alpha_{17}$ of these sine functions reveals that the maximum amplitude value αmax and the second-largest amplitude value α2nd are included in the amplitude values $\alpha_2$, $\alpha_3$, $\alpha_4$, as from the second-order sine function through the fifth-order sine function. Specifically, in the low-N-noise arrangement having the characteristics illustrated in FIG. 4, the conditions $\alpha max=\alpha 2nd$ and $\alpha max<2\times\alpha 2nd$ are satisfied.

The low-N-noise arrangement having the characteristics illustrated in FIG. 4 is furthermore disposed such that the second-largest amplitude value $\alpha 2nd$ and the third-largest amplitude value $\alpha 3rd$ are within a range of 50-100% of the maximum amplitude value with respect to the amplitude values $\alpha_m$ of the sine functions at individual orders m. Specifically, the maximum amplitude value $\alpha max$, the second-largest amplitude value $\alpha 2nd$, and the third-largest amplitude value $\alpha 3rd$ satisfy the relationships $\alpha max/2\leq\alpha 2nd\leq\alpha max$, and $\alpha max/2\leq\alpha 3rd\leq\alpha max$. With reference to FIG. 4, because the amplitude values $\alpha_2$, $\alpha_3$, $\alpha_4$, $\alpha_5$ from the second-order sine function through the fifth-order sine function are all 250, the relationship $\alpha max=\alpha 2nd=\alpha 3rd=\alpha 4th$ is satisfied. $\alpha 4th$ is the fourth-largest amplitude value.

In the low-N-noise arrangement having the characteristics illustrated in FIG. 4, the amplitude values of 15 orders other than the first order are equal to or greater than 125, which is half of the maximum amplitude value $\alpha max$; 15 of the 17 orders are within a range of 75-100% of the maximum amplitude value $\alpha max$. Specifically, in the low-N-noise arrangement having the characteristics illustrated in FIG. 4, the amplitude values $\alpha_m$ (m=2, . . . , 17) of the sine functions at orders numbering one-third of the total number of orders of the periodic Fourier series, and furthermore at orders numbering one-half of the total number of orders of the periodic Fourier series, are within a range of 50-100% of the maximum amplitude value $\alpha max$.

Moreover, a selection is made from lower orders where the order of a sine function that has an amplitude value within a range of 50-100% of the maximum amplitude value $\alpha max$ is two or greater. Although difficult to understand from the low-N-noise arrangement having the characteristics illustrated in FIG. 4, this means that sine functions from the second order to the fifth order are sequentially selected from the lower orders of two and greater in the following sequence: sine function having the maximum amplitude value $\alpha max$, sine function having the second-largest amplitude value $\alpha 2nd$, sine function having the third-largest amplitude value $\alpha 3rd$, and sine function having the fourth-largest amplitude value $\alpha 4th$. For example, the amplitude value $\alpha_m$ should be determined so that an amplitude value $\alpha_n$ having a certain order and belonging to amplitude values $\alpha_m$ (m=2, . . . , 17) having an order except one is equal to or greater than an amplitude value $\alpha_{n+1}$ having a higher order than the order of the amplitude value $\alpha_n$.

Because this concept is difficult to understand from the low-N-noise arrangement having the characteristics illustrated in FIG. 4, an example is given in which the amplitude value $\alpha 4$ of a fourth-order sine function is $\alpha max=300$, where $\alpha 2nd=290$, $\alpha 3rd=280$, and smaller amplitude values are respectively equal to 270, 260, 250, 240, 230, 220, 210, 100, 90, 80, 70, 60, 50, and 0. In this case, the order of the sine functions is selected such that, e.g., the amplitude value $\alpha_2$ of a second-order sine function is 290, the amplitude value $\alpha_3$ of a third-order sine function is 280, the amplitude value $\alpha_5$ of a fifth-order sine function is 270, the amplitude value $\alpha_6$ of a sixth-order sine function is 260, the amplitude value $\alpha_7$ of a seventh-order sine function is 250, the amplitude value $\alpha_8$ of an eighth-order sine function is 240, the amplitude value $\alpha_9$ of a ninth-order sine function is 230, the amplitude value $\alpha_{10}$ of a tenth-order sine function is 220, and the amplitude value $\alpha_{11}$ of an eleventh-order sine function is 210. In this case, the sine functions of orders higher than twelve may be selected in any manner. However, as shall be described later, the amplitude value $\alpha 1$ of a first-order sine function is preferably selected so as to be the minimum amplitude value $\alpha min$; i.e., zero. In this case as well, the inter-blade pitch angle arrangement $\theta_k$ is configured such that the amplitude values $\alpha_m$ (m=2, 3, 5, . . . , 11) of the sine functions at orders numbering one-half of the total number of orders of the periodic Fourier series are disposed within a range of 50-100% of the maximum amplitude value $\alpha max$.

With respect to the amplitude values $\alpha_m$, it is furthermore preferable to set the amplitude values of all of the orders included in m>M/2 so as to be 0.6-0.8 times the amplitude value $\alpha 2$ of the second-order sine function. Setting the amplitude values in this manner enhances the effect for dispersing NZ noise.

In the low-N-noise arrangement having the characteristics illustrated in FIG. 4, the amplitude value $\alpha 1$ of the first-order sine function is 0. In a case in which a configuration is adopted as described above, and an arrangement is adopted such that N noise can be minimized, only the amplitude value $\alpha 1$ of the first-order sine function contributes to rotational balance; therefore, a design can be adopted such that, when the amplitude value $\alpha_1$ of the first-order sine function approaches zero, the center of gravity in a cross-section perpendicular to the rotational axis O of the cross-flow fan 10 does not substantially deviate from the axis. For this reason, the amplitude value $\alpha_1$ of the first-order sine function is set to 0 in the low-N-noise arrangement having the characteristics illustrated in FIG. 4.

Figure 5:
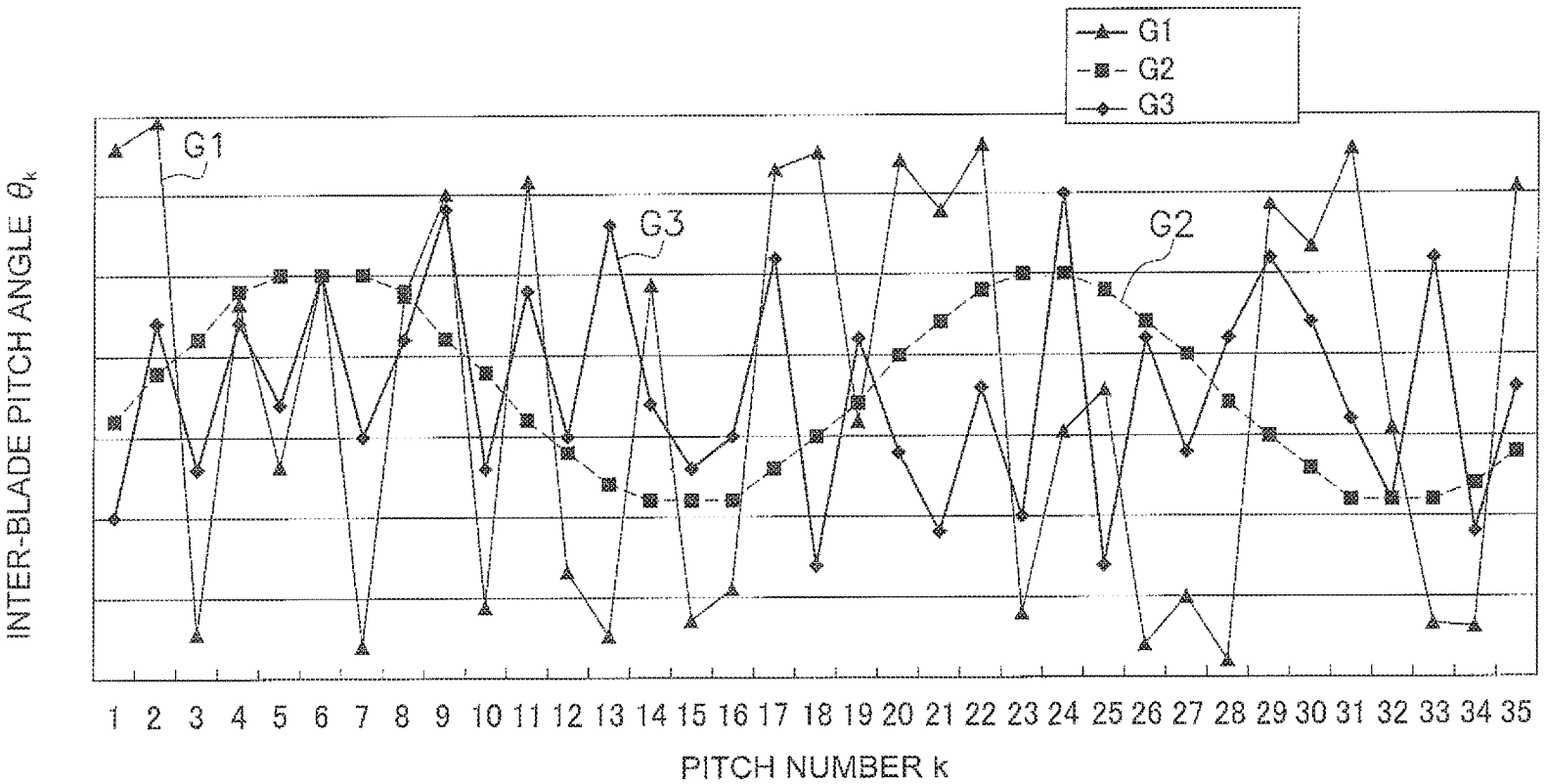
FIG. 5 is a graph for illustrating inter-blade pitch angle arrangements.

FIG. 5 shows three inter-blade pitch angle arrangement $\theta_k$. In FIG. 5, the inter-blade pitch angle arrangement $\theta_k$ indicated by graph G1, which is plotted using triangles, is a low-N-noise arrangement having the characteristics illustrated in FIG. 4. The amplitude value $\alpha_m$ of the sine functions is preferably set as described above in order to minimize N noise, and the effect for minimizing N noise can be obtained irrespective of the method in which the phase shift $\beta_m$ is set; therefore, the low-N-noise arrangement shown in FIG. 5 is obtained by suitably setting the phase shift $\beta_m$ such that the difference between the maximum value and minimum value of the inter-blade pitch angle arrangement $\theta_k$ is not particularly large. For example, when an inter-blade pitch angle $\theta_2$ of pitch number 2 is applied to an actual fan block 30, the interval between the blade 101 and the blade 102 is determined such that the inter-blade pitch angle Pt2 in FIG. 3 is $\theta 2$.

(3) Characteristics (3-1)

As described above, the plurality of blades 100, 101-135 of the cross-flow fan (an example of a multi-blade fan) are secured to the support plate 50 (an example of a support body). The plurality of blades 100, 101-135 are disposed in a low-N-noise arrangement (an example of a prescribed arrangement) having the characteristics illustrated in FIG. 4 such that, with respect to the amplitude values $\alpha_m$ of the sine functions (an example of periodic functions) at individual orders when the inter-blade pitch angle arrangement $\theta_k$ is expanded in a periodic Fourier series, the maximum amplitude value $\alpha max$ is 250, the same as the second-largest amplitude value $\alpha 2nd$. Specifically, it is possible to consider a disposition such that the maximum amplitude value $\alpha max$ is less than 200% of the second-largest amplitude value $\alpha 2nd$. As a result, the inhibition of noise reduction, caused by the prominence of only a order that has the maximum amplitude value $\alpha max$ and the production of unpleasant low-frequency noise, is mitigated. Specifically, a cross-flow fan 10 configured using a fan block 30 shown in FIG. 3 that has an inter-blade pitch angle arrangement $\theta_k$ such as is shown in the graph G1 of FIG. 5 makes it possible not only to reduce wind noise and low-frequency broadband noise, but also to suppress the prominence of specific discrete-frequency noise and to enhance a noise-reduction property.

In particular, in the low-N-noise arrangement having the characteristics illustrated in FIG. 4, the plurality of blades 100, 101-135 are disposed such that, with respect to the amplitude values $\alpha_m$ of the sine functions at individual orders when the inter-blade pitch angle arrangement $\theta_k$ is expanded in a periodic Fourier series, the second-largest amplitude value $\alpha$2nd and the third-largest amplitude value $\alpha$3rd are 250, the same as the maximum amplitude value $\alpha$max. Specifically, it is possible to consider a disposition such that the second-largest amplitude value $\alpha$2nd and the third-largest amplitude value $\alpha$3rd are within a range of 50-100% of the maximum amplitude value $\alpha$max. As a result, the magnitudes of the amplitude values of sine functions having large relative amplitude values are not far removed from each other; therefore, the effects of not only the sine function having the maximum amplitude value $\alpha$max but also the sine function having the second-largest amplitude value are insignificant.

This effect increases in accordance with increases in the orders within a range of 50-100% of the maximum amplitude value $\alpha$max; a disposition such that the amplitude values of the sine functions at a number of orders equal to or greater than one-third of the total number of orders of the periodic Fourier series are within a range of 50-100% of the maximum amplitude value is preferred, and a disposition such that the amplitude values of the sine functions at a number of orders equal to or greater than one-half of the total number of orders of the periodic Fourier series are within a range of 50-100% of the maximum amplitude value is more highly preferred.

Figure 6:
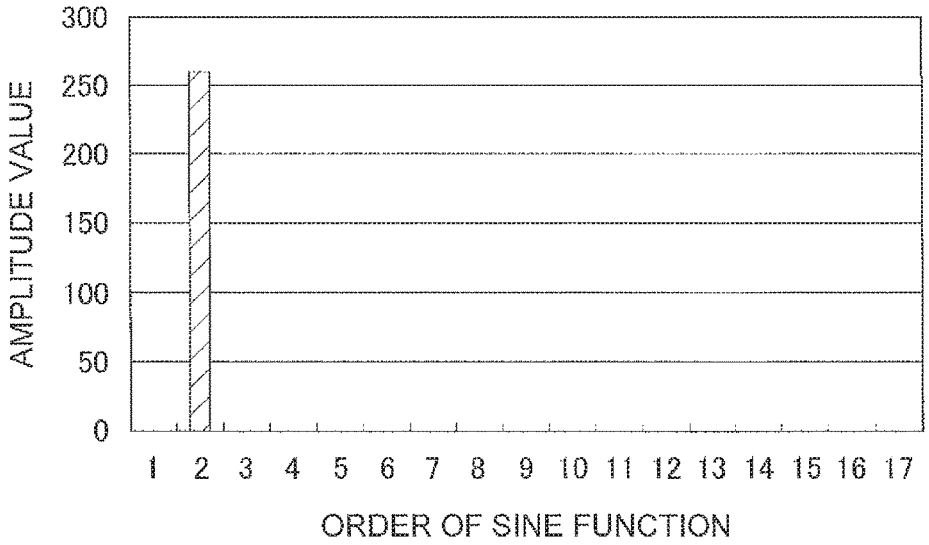
FIG. 6 (PRIOR ART)
FIG. 6 is a graph showing one example of a conventional relationship between sine function order and amplitude value.
Figure 7:
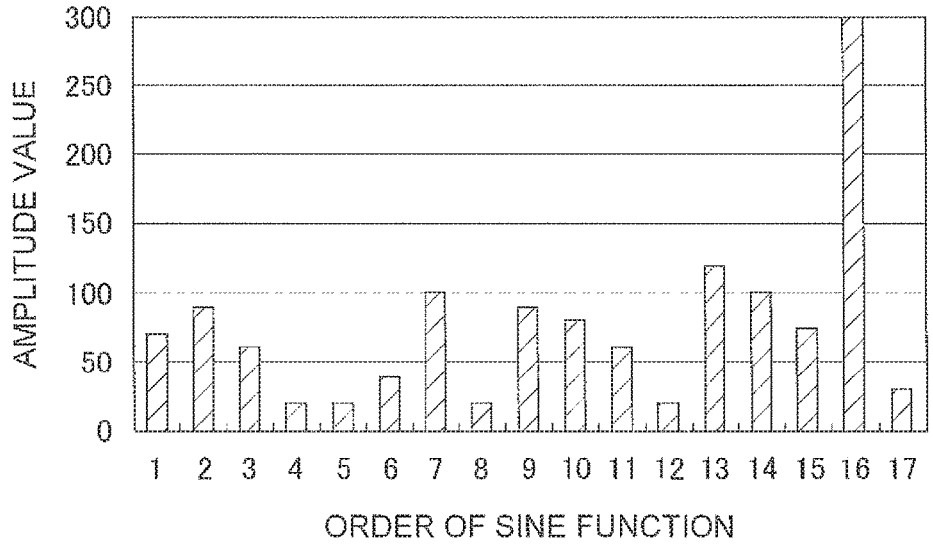
FIG. 7 (PRIOR ART)
FIG. 7 is a graph showing one example of a conventional relationship between sine function order and amplitude value.

This effect will be described in detail while comparing a cross-flow fan having a random pitch angle arrangement in which the blades are disposed at uneven intervals having randomly varied pitch angles, and the cross-flow fan disclosed in Patent Document 1. In the cross-flow fan disclosed in Patent Document 1, only the amplitude value $\alpha_2$ of the second-order sine function has a value when the inter-blade pitch angle arrangement is expanded in a periodic Fourier series; the amplitude values of the sine functions of other orders are zero. In cases in which this configuration is applied to a cross-flow fan having 35 blades, similarly to the embodiment of the present invention, the blades are disposed so as to have an inter-blade pitch angle arrangement $\theta_k$ expanded in a periodic Fourier series such as is shown in FIG. 6. The inter-blade pitch angle arrangement $\theta_k$ expanded in a periodic Fourier series shown in FIG. 6 is the inter-blade pitch angle arrangement $\theta_k$ indicated by graph G2, which is plotted using squares, in FIG. 5. One example of a cross-flow fan having a random pitch angle arrangement has the inter-blade pitch angle arrangement $\theta_k$ expanded in a periodic Fourier series shown in the graph in FIG. 7. The inter-blade pitch angle arrangement $\theta_k$ expanded in the periodic Fourier series shown in the graph in FIG. 7 is the inter-blade pitch angle arrangement $\theta_k$ indicated by graph G3, which is plotted using rhombuses, in FIG. 5.

Figure 8:
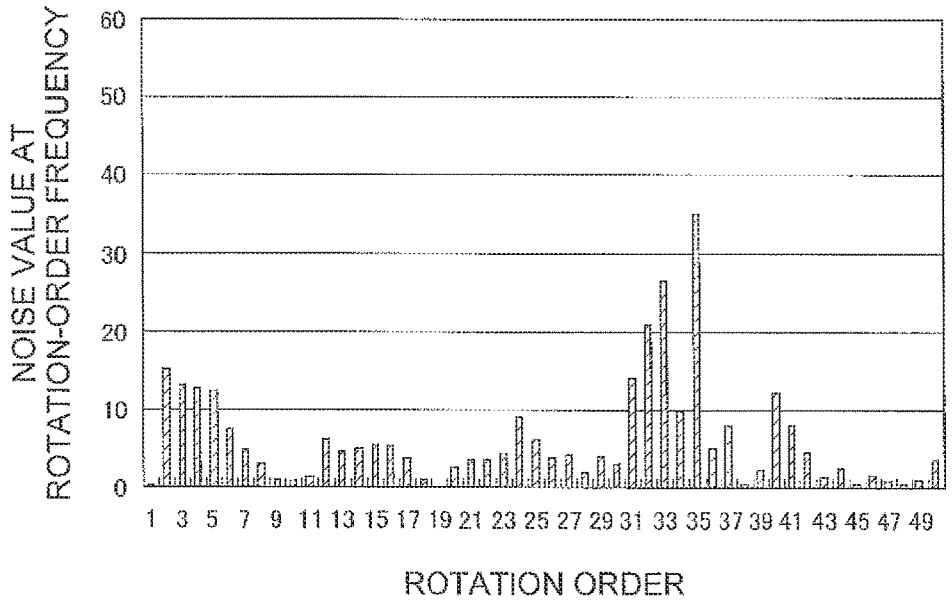
FIG. 8 is a graph showing noise values for each rotation-order frequency generated by a cross-flow fan having the characteristics illustrated in FIG. 4.
Figure 9:
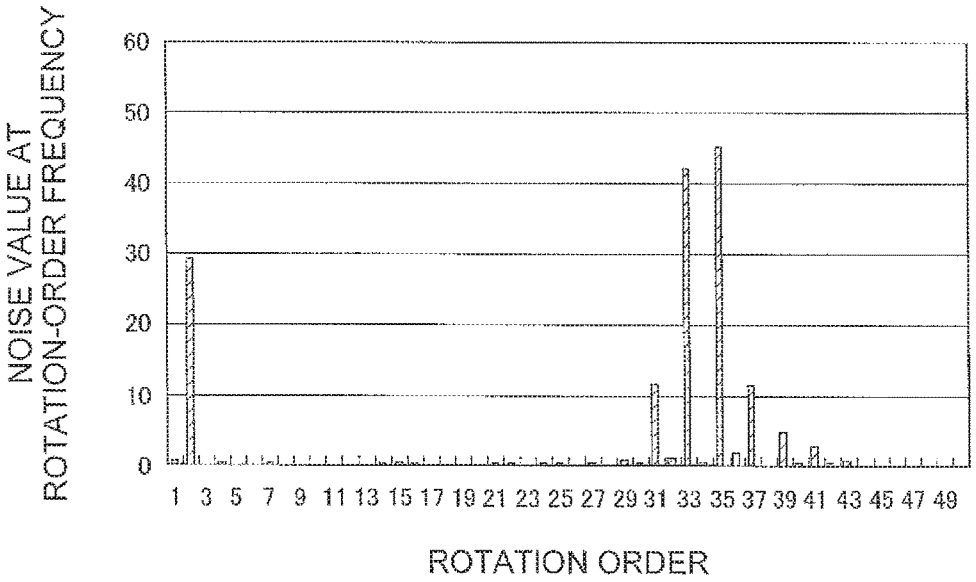
FIG. 9 is a graph showing noise values for each rotation-order frequency generated by a cross-flow fan having the characteristics illustrated in FIG. 6.
Figure 10:
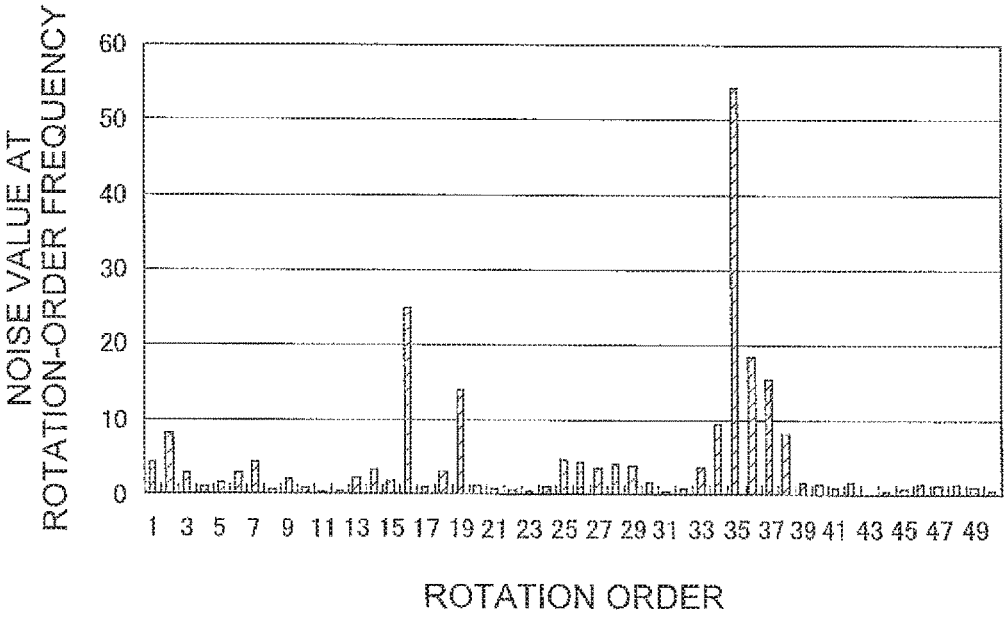
FIG. 10 is a graph showing noise values for each rotation-order frequency generated by a cross-flow fan having the characteristics illustrated in FIG. 7.

FIG. 8 is a graph obtained by performing a Fourier transform on the noise generated by the cross-flow fan 10, and indicating noise values for each rotation-order frequency. FIG. 9 is a graph obtained by performing a Fourier transform on the noise generated by a cross-flow fan having the inter-blade pitch angle arrangement $\theta_k$ illustrated in FIG. 6, and indicating noise values for each rotation-order frequency. FIG. 10 is a graph obtained by performing a Fourier transform on the noise generated by a cross-flow fan having the inter-blade pitch angle arrangement $\theta_k$ illustrated in FIG. 7, and indicating noise values for each rotation-order frequency. The second-order rotation-order frequency is, e.g., 2×the number of rotations (rpm/60). The same scale is used on the vertical axes of FIGS. 8, 9, and 10 for ease of comparison. Although the numerical values on this scale have no significance in and of themselves, they express the logarithm of the ratio relative to a reference amount in order to allow the noise values to be compared.

It can be expected that low-frequency noise having the same frequency as the second-order sine function will be prominent in a cross-flow fan having an inter-blade pitch angle arrangement $\theta_k$ such as is shown in FIG. 6, as shall be apparent. Actually, as shown in FIG. 9, second-order rotation-order N noise is strongly prominent; such noise is perceived as unnatural and unusually unpleasant because sound corresponding to a strongly prominent rotation order is present in a low-frequency band. Thus, in a cross-flow fan having an inter-blade pitch angle arrangement $\theta_k$ obtained by expanding a Fourier series configured only from second-order sine functions, the energy of NZ noise is dispersed disproportionately only at certain rotation-order frequencies, and the rotation-order frequencies at which the dispersed energy is dispersed are limited. Noise in which frequencies other than the NZ frequencies are prominent is therefore generated.

It is apparent from FIG. 10 that the amplitude value of a frequency corresponding to a $16^{th}$-order sine function is prominent. In a cross-flow fan having an inter-blade pitch angle arrangement $\theta_k$ such as is illustrated by graph G3 in FIG. 5, the energy of NZ noise (noise corresponding to a $35^{th}$-order rotation-order frequency) is dispersed at other rotation-order frequencies; however, because the inter-blade pitch angle arrangement $\theta_k$ is determined randomly, audibly unpleasant noise is generated as a result, due to the prominence of the amplitude value at a frequency corresponding to the $16^{th}$-order sine function.

As seen in the distribution of noise values at the rotation-order frequencies shown in FIG. 8, it is apparent that these NZ noise values are lower than those shown in FIGS. 9 and 10, and that the energy is more widely dispersed at other rotation-order frequencies than in FIGS. 9 and 10 in correspondence with this reduction in NZ noise. Therefore, irrespective of the great reduction in NZ noise, the generation of N noise is also minimized. As a result, in the cross-flow fan 10, it is possible not only to reduce wind noise and low-frequency broadband noise, but also to suppress the prominence of specific discrete-frequency noise and to enhance a noise-reduction property.

(3-2)

Additionally, in the plurality of blades 100, 101-135, a selection is made from lower orders where the order of a sine function that has an amplitude value within a range of 50-100% of the maximum amplitude value is two or greater. Because the amplitude values of low-order-side periodic functions are grouped so as to be within a range of 50-100% of the maximum amplitude value, the effect for dispersing NZ noise in the cross-flow fan 10 is enhanced. For example, as in the low-N-noise arrangement having the characteristics illustrated in FIG. 4, the amplitudes of second-order to eighth-order sine functions are close to the maximum amplitude value $\alpha$max, and the amplitude values of the second-order to fifth-order sine functions are uniformly increased so as to approach the maximum amplitude value $\alpha$max, whereby a high NZ-noise-dispersing effect is obtained. Additionally, the amplitudes of second-order to eighth-order sine functions are set to 0.8 or more of the maximum amplitude value αmax, whereby a further improved NZ-noise-dispersing effect is obtained.

(3-3)

The plurality of blades 100, 101-135 are disposed in a low-N-noise arrangement having the characteristics illustrated in FIG. 4, such that the first-order amplitude value when the inter-blade pitch angle arrangement is expanded in a periodic Fourier series is zero, and are disposed such that the center of gravity does not significantly deviate from the shaft. Having the blades be disposed in this manner reduces the likelihood of disruption to the rotational balance of the cross-flow fan 10, and makes it possible to minimize problems due to any such disruption.

(4) Modifications (4-1)

In the embodiment given above, a description is given using a cross-flow fan as an example of a multi-blade fan. However, the multi-blade fans to which the present invention can be applied are not limited to transverse fans such as cross-flow fans; rather, the present invention can be applied to centrifugal fans or other multi-blade fans.

(4-2)

In the embodiment given above, sine functions are used as the periodic functions when the prescribed disposition is to be expanded in a periodic Fourier series. However, periodic functions other than sine functions; e.g., cosine functions or the like, may be used.

What is claimed is:

1. A multi-blade fan comprising:

a support body rotatable about a rotary shaft; and a plurality of blades secured to the support body such that an inter-blade pitch angle relative to the rotary shaft assumes a prescribed arrangement, the blades extending along an axial direction of the rotary shaft, the plurality of blades being disposed such that, with respect to amplitude values of periodic functions at individual orders when the prescribed arrangement is expanded in a periodic Fourier series, a maximum amplitude value is less than 200% of a second-largest amplitude value, the amplitude values being determined such that a first amplitude value having a certain order and belonging to amplitude values having an order except one is equal to or greater than a second amplitude value having a higher order than the order of the first amplitude value, the second amplitude value is equal to or greater than a third amplitude value having a higher order than the order of the second amplitude value, the third amplitude value is equal to or greater than a fourth amplitude value having a higher order than the order of the third amplitude value, and the fourth amplitude value is equal to or greater than a fifth amplitude value having a higher order than the order of the fourth amplitude value, with each (n+1)-order amplitude value being equal to or greater than each (n+2)-order amplitude value, wherein n represents an integer of 1 through 15.

2. The multi-blade fan according to claim 1, wherein the plurality of blades are disposed such that, with respect to the amplitude values of periodic functions at individual orders of the periodic Fourier series, the second-largest amplitude value is equal to or less than 100% of the maximum amplitude value and the third-largest amplitude value is within a range of 50-100% of the maximum amplitude value.

3. A multi-blade fan comprising:

a support body rotatable about a rotary shaft; and a plurality of blades secured to the support body such that an inter-blade pitch angle relative to the rotary shaft assumes a prescribed arrangement, the blades extending along an axial direction of the rotary shaft, the plurality of blades being disposed such that, with respect to amplitude values of periodic functions at individual orders when the prescribed arrangement is expanded in a periodic Fourier series, a maximum amplitude value is less than 200% of a second-largest amplitude value, the plurality of blades being disposed such that the amplitude values of periodic functions at a number of orders equal to or greater than one-half of a total number of orders of the periodic Fourier series are within a range of 50-100% of the maximum amplitude value, the plurality of blades being disposed such that a selection is made from lower orders where the order of a periodic function that has an amplitude value within a range of 50-100% of a maximum amplitude value is two or greater, and the plurality of blades being disposed such that a first-order amplitude value when the prescribed arrangement is expanded in a periodic Fourier series is less than 50% of the maximum amplitude value.

4. The multi-blade fan according to claim 3, wherein the plurality of blades are disposed such that, with respect to the amplitude values of periodic functions at individual orders of the periodic Fourier series, the second-largest amplitude value is equal to or less than 100% of the maximum amplitude value and the third-largest amplitude value is within a range of 50-100% of the maximum amplitude value.

5. The multi-blade fan according to claim 3, wherein the plurality of blades are disposed such that the first-order amplitude value when the prescribed arrangement is expanded in a periodic Fourier series is zero.

6. A multi-blade fan comprising:

a support body rotatable about a rotary shaft; and a plurality of blades secured to the support body such that an inter-blade pitch angle relative to the rotary shaft assumes a prescribed arrangement, the blades extending along an axial direction of the rotary shaft, the plurality of blades being disposed such that, with respect to amplitude values of periodic functions at individual orders when the prescribed arrangement is expanded in a periodic Fourier series, a maximum amplitude value is less than 200% of a second-largest amplitude value, the plurality of blades being disposed such that the amplitude values of periodic functions at a number of orders equal to or greater than one-half of a total number of orders of the periodic Fourier series are within a range of 50-100% of the maximum amplitude value, and the plurality of blades being disposed such that a first-order amplitude value when the prescribed arrangement is expanded in a periodic Fourier series is zero.

7. The multi-blade fan according to claim 6, wherein the plurality of blades are disposed such that, with respect to the amplitude values of periodic functions at individual orders of the periodic Fourier series, the second-largest amplitude value is equal to or less than 100% of the maximum amplitude value and the third-largest amplitude value is within a range of 50-100% of the maximum amplitude value.

* * * * *